United States Patent [19]

Thompson

[11] 4,403,898

[45] Sep. 13, 1983

[54] PIPE PICK-UP AND LAYDOWN MACHINE

[76] Inventor: Carroll R. Thompson, 2818 W. 42nd St., Odessa, Tex. 79760

[21] Appl. No.: 336,250

[22] Filed: Dec. 31, 1981

[51] Int. Cl.[3] ..... E21B 19/14

[52] U.S. Cl. ..... 414/22; 175/85; 414/595; 414/598; 414/748

[58] Field of Search ..... 414/22, 745, 747, 748, 414/595, 598; 166/75 R, 77.5; 175/85

[56] References Cited

U.S. PATENT DOCUMENTS

| | | | |
|---|---|---|---|
| Re. 24,907 | 12/1960 | Maydew | 414/22 |
| 2,643,006 | 6/1953 | King | 414/22 |
| 3,041,112 | 6/1962 | Carmichael, Jr. | 414/598 X |
| 3,143,221 | 8/1964 | Blackmon | 414/22 |
| 3,217,900 | 11/1965 | Kupetzky et al. | 414/742 |
| 3,651,959 | 3/1972 | Castela et al. | 414/22 |
| 4,054,210 | 10/1977 | Crocker | 414/748 X |
| 4,083,193 | 4/1978 | Evans | 405/208 X |
| 4,235,566 | 11/1980 | Beeman et al. | 175/85 X |
| 4,371,302 | 2/1983 | Frias et al. | 414/745 X |

*Primary Examiner*—Robert J. Spar
*Assistant Examiner*—Janice Krizek
*Attorney, Agent, or Firm*—Pravel, Gambrell, Hewitt, Kirk & Kimball

[57] ABSTRACT

A pipe pick-up and laydown machine for lifting a joint of pipe from a generally horizontal position on a pipe rack to an inclined and elevated position relative to an elevated rig floor for connection to rig elevators by the drilling crew. The apparatus includes a horizontal base position adjacent the pipe racks with a pipe carrying trough slidably mounted in a trough trestle which can telescope in and out of one end of the trestle. An inclined track extends from one end of the base to a position near the edge of the rig floor and structure is provided for lifting the front end of the trough trestle along the inclined track. The rear end of the trough trestle is mounted on a sliding articulating arm which first moves forward as the front end of the trough trestle is elevated on the inclined track and then stops and pivots to raise the rear end of the trestle to incline the pipe carrying trough at a desired elevation when extended over one edge of the rig floor. The operation is reversed when laying down pipe. The apparatus also can roll pipe to pipe racks positioned on either side of the apparatus.

2 Claims, 13 Drawing Figures

99
49
45
41
44
L
46
48
48'
14
13
2
2
80
B
C
28
32
K
F
S
R 81
86
101b
101a
14
B
104
101
12
91a
91
106a
62a
T'
83
62
15
90a
90
108a
85
87
80
102b
102a
103
102
13

PIPE PICK-UP AND LAYDOWN MACHINE

TECHNICAL FIELD OF THE INVENTION

In drilling or completing oil or gas wells various strings of pipe are made up or disconnected in a vertical position in the derrick one joint at a time and are stored horizontally on pipe racks adjacent the rig. The floor of the rig is elevated substantially above the pipe rack and therefore transferring a pipe between the pipe racks and the elevated rig floor requires careful handling both to protect the pipe and the personnel around the rig. Numerous solutions to the problem of transferring pipe from rack to rig have been suggested: for example, U.S. Pat. Nos. 4,083,193; 4,054,210; and 4,235,566.

Heavy joints of casing or drill collars are more difficult to handle than smaller and lighter pipe such as drill pipe and therefore require more stable and more sophisticated pipe handling equipment including means for controlling the rate of acceleration and deceleration involved in moving massive objects to protect the pipe as well as the pipe handling apparatus.

SUMMARY OF THE INVENTION

An apparatus for transferring pipe between the pipe rack and the rig floor and particularly large diameter heavy casing, drill collars as well as drill pipe, includes a horizontal base structure to be positioned on the ground between the pipe racks so as to receive pipe from either side. Nested within the base is a trough trestle, the front end of which is attached to cariages slidably mounted on an inclined track which guides the front end of the trestle as it is raised from the base to a position adjacent the rig floor. The rear end of the trestle remote from the drilling rig has an articulated support leg, the upper end of which is pivotally connected to the trestle and the lower end of which is slidably mounted in the track in the base so that as the front end of the trestle is moved upwardly along the inclined track the rear articulated leg first slides forward in the track to a stop and then pivots and swings the rear of the trestle upwardly to a desired elevation. A telescopically mounted pipe receiving trough is mounted in the trough trestle which is moved outwardly to project the pipe over the rig floor at a height convenient for the reach of the rig crew who connect the upper end of the pipe to the rig elevators or other lifting apparatus in the derrick.

Reversal of the above procedure will enable a joint of pipe to be lowered from a suspended position in the derrick to the pipe rack or storage. The present invention includes means for tilting the trough to either side for discharging pipe to the racks on either side as desired. The present invention also includes means for controlling acceleration and deceleration of the trough and trough trestle and lifting and lowering operations to avoid shock loads imposed by sudden stopping with massive loads imposed on the structure.

DESCRIPTION OF THE PREFERRED EMBODIMENT

Figures 1, 2:
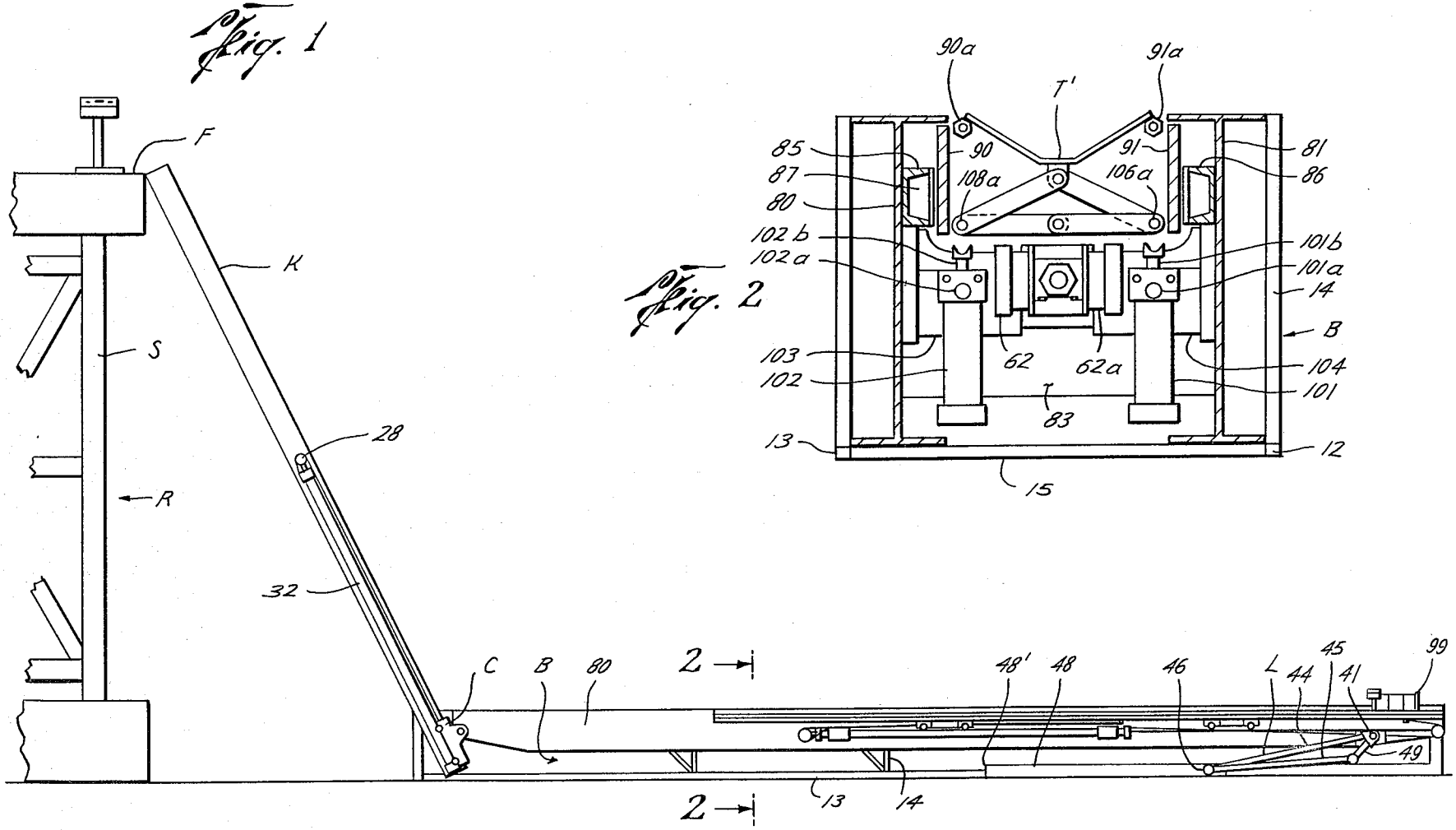
FIG. 1 is a partial side elevation of an elevated rig floor with the pipe handling apparatus shown partially in elevation and partially in section in the nested position for receiving pipe from the adjacent pipe rack.
FIG. 2 is a sectional view taken on line 2—2 of FIG. 1 showing details of the trough mounted in the trough trestle in a position for receiving a joint of pipe.

Illustrated in FIGS. 1 and 2 of the drawings is the base support B which comprises a plurality of longitudinally extending structural members 12 and 13 which are secured together by vertical supports 14 and horizontal members 15 to form an open top U-shaped truss which is adapted to be positioned on the ground adjacent a drilling rig R between the pipe rack (not shown) in the position usually occupied by the catwalk. Nested within the open-top U-shaped base member B is the trough trestle T in which the trough T' is telescopically mounted. The trough trestle T is supported at its front end by the carriage C which runs on the spaced inclined tracks K which extend from the front end of the base B upwardly to a point adjacent the edge of the elevated rig floor F. As shown, the rig R includes substructure S as well as rig floor F with the rig floor being supported at an elevation of twenty to forty feet above the ground on the substructure S depending upon the particular drilling rig configuration. If desired, the track K can be inclined at the same angle adjacent to the normal V door ramp and secured to the rig substructure or other suitable support means.

The carriage C comprises a U-shaped channel body including rollers 20 received in facing U-shaped channel tracks 22 which are secured in spaced relation by suitable transverse members or a plate 22', as desired.

The carriage has ears 24 which receive pin 25 for pivotally mounting the trough trestle T to the carriage. Such carriage C is connected to a pair of chains 27 which are rove over a pair of spaced sheaves 28 mounted on the end of the hydraulic lift piston 29 positioned within the U-shaped channel 30 on which the rollers 20 are mounted. One end of the chain 27 is secured to the lift piston cylinder 32 which is mounted on the forward end of the base B or to some point on the inclined track K, as desired. The other end of the chain 27 is secured to the carriage C by a suitable pin or other securing means 33.

Figure 6:
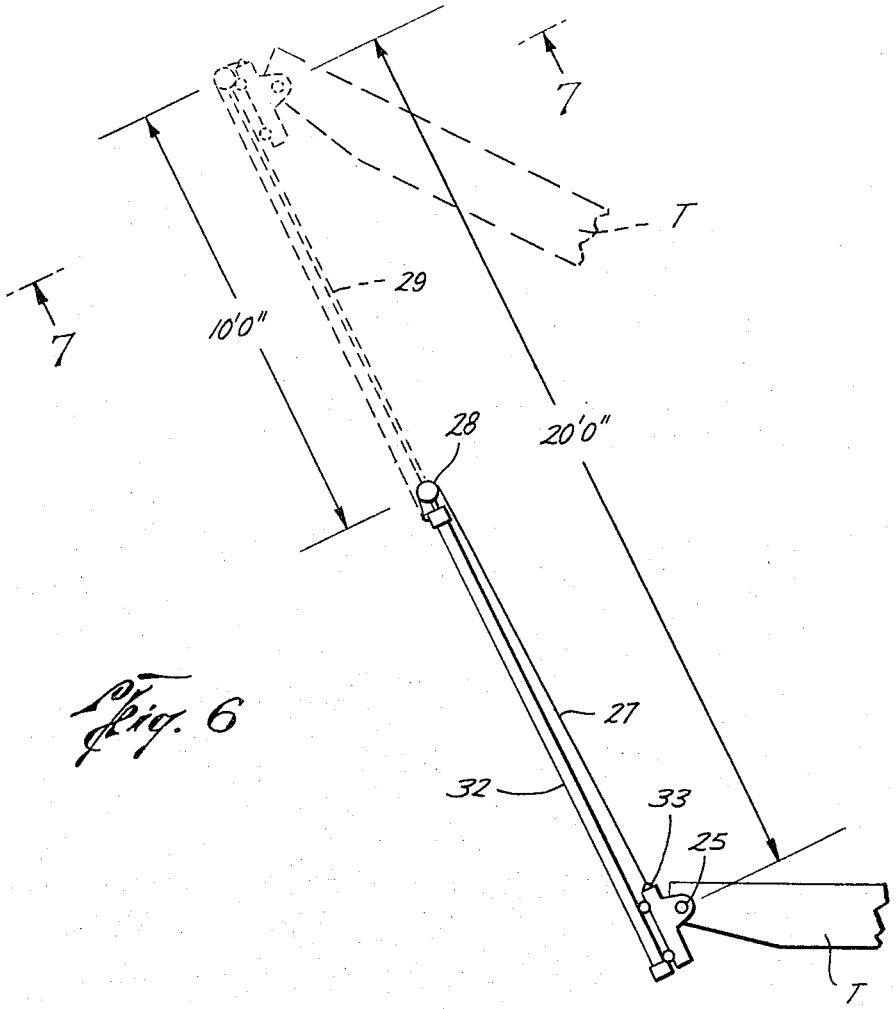
FIG. 6 is a schematic view showing the lift cylinder and carriage arrangement for lifting the forward end of the trough trestle along the inclined track.
Figure 7:
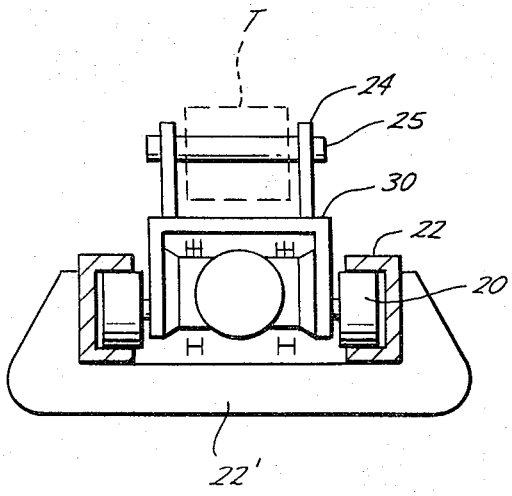
FIG. 7 is a sectional view taken on line 7—7 of FIG. 6 showing additional details of the carriage apparatus from the forward end of the trough trestle along the inclined track.

The piston in the lift cylinder 32 travels approximately half of the distance travelled by the carriage C due to the chain drive arrangement shown in FIG. 6.

The rear end of the trough trestle T is carried on the articulated leg L which comprises a triangular truss type member having a forward or upper leg 44 and a shorter or lower leg 45 with the ends of such legs connected together by a pin which carries a roller 46 that moves in the track 48. A short leg 49 connects the ends of the legs 45 and 44 to form the articulated leg L. The track 48 includes a stop 48' at the forward end which limits forward movement of the roller 46 on the forward end of the articulated leg L. When the front end of the trough truss T is raised along the inclined track K into the successive positions shown in FIGS. 4 and 5 the rear end of the trough trestle T is first moved forward until the roller 46 engages the stop 48' and thence the continued upward and forward movement of the carriage C along the inclined track K causes the rear end of the trough trestle to move upwardly and forwardly on the articulated leg L. With this arrangement no independent vertical assist is required to assist in the initial lifting of the rear end of the trough trestle T'.

Figure 4:
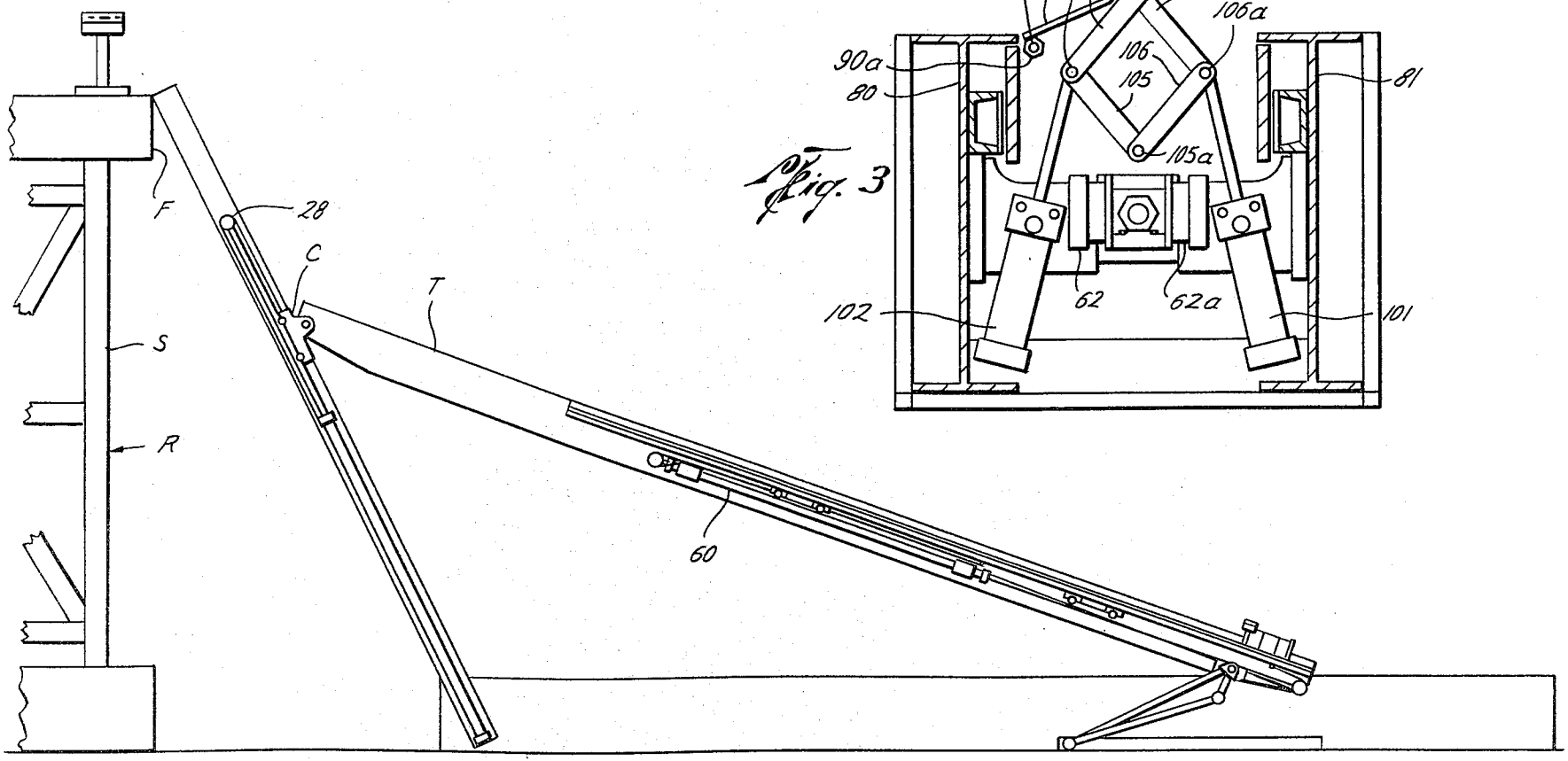
FIG. 4 is a view partially in elevation and partially in section showing the trough trestle in an intermediate position between the nested position shown in FIG. 1 and the fully raised position shown in FIG. 5.
Figure 5:
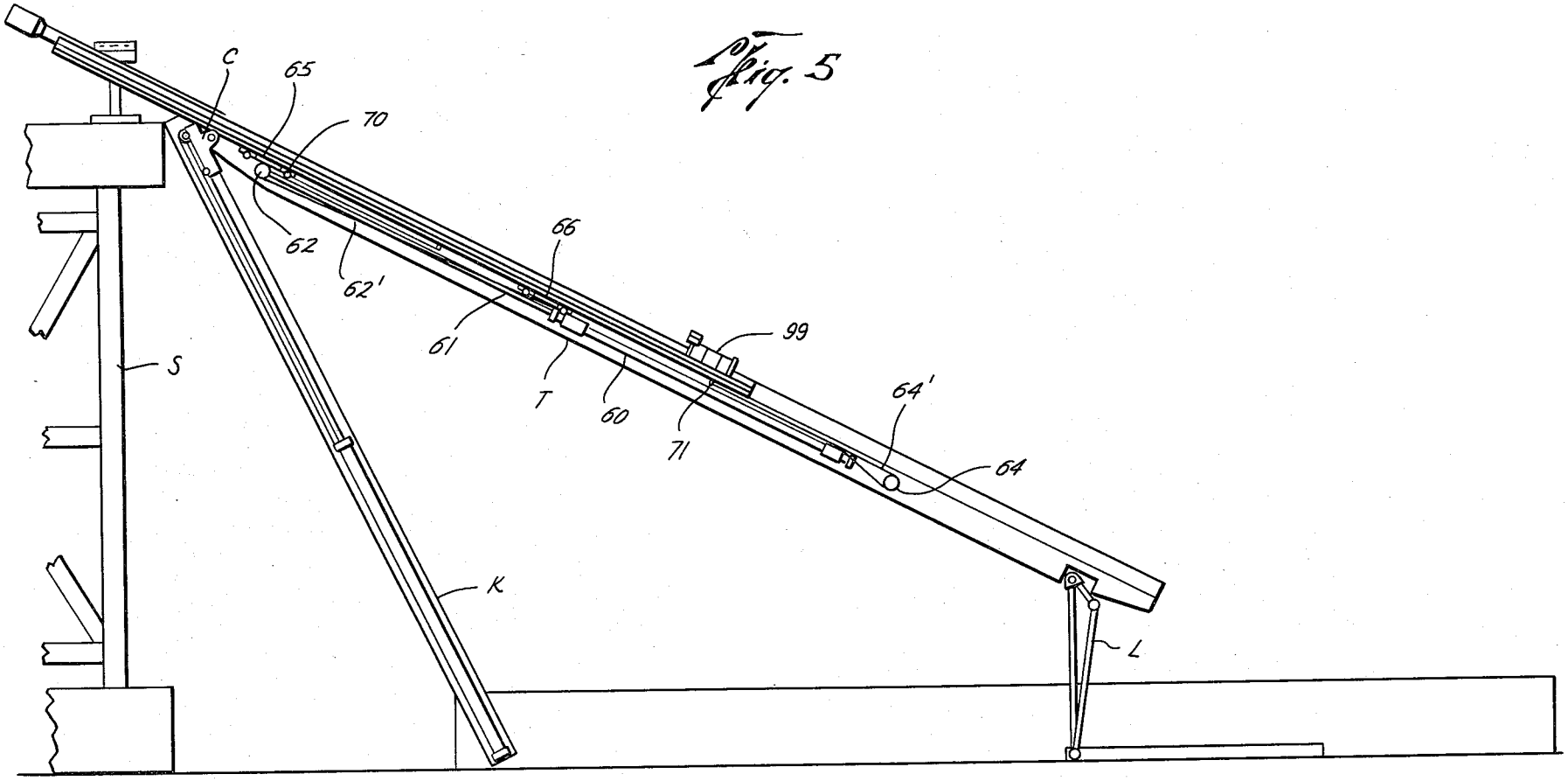
FIG. 5 is a view partially in elevation and partially in section showing the pipe handling apparatus in the elevated position with the trough carrying the pipe extended to position the end of the pipe above the edge of the rig floor.

After reaching the uppermost position shown in FIG. 5, the trough T' is moved telescopically relative to the trough trestle T by means of a double acting hydraulic cylinder 60 as shown in FIGS. 4 and 5. In FIG. 4 the trough T' is in a retracted position relative to the trestle T and in FIG. 5 the trough T' is shown in a telescopically extended position relative to the trough trestle T. A single piston rod 61 extends through the cylinder 60 and is provided with a piston (not shown) which may be shifted hydraulically from end to end of the cylinder 60. Chain sheaves 62 and 64 are secured to the upper and lower ends, respectively, of the rod 61 for receiving drive chain 62' and 64' connected to the trough upper and lower trolleys, 65 and 66 on the trough T'.

One end of the chain 62' is connected to the trough T' at 70 and the other end of such chain is connected to the cylinder 60 or supporting structure; similarly, one end of the chain 64' is connected to the trough at 71 and the other end is connected to the cylinder 60 or supporting structure.

With the chain 62' and 64' rove over their respective sheaves 62 and 64 mounted on the common piston rod 61, it will be appreciated that the double acting cylinder 60 provides positive hydraulic control means for both extending and retracting the trough T' with respect to the trough trestle T to thereby provide a positive control for accelerating and decelerating motion of the loaded trough T'. As the rod 61 is shifted upwardly from the position shown in FIG. 4 to the position shown in FIG. 5 the chain moves the trough T' from its retracted position to the extended position for placing the end of the pipe P over the edge of the rig floor F. Of course, it will be appreciated that the trough T' is not shifted to its telescopically extended position until after the trough trestle T has been raised to a sufficient elevation to enable the end of the trough T' to clear the upper edge of the rig floor F. Similarly, in lowering the loaded trough T' the piston in the cylinder 60 is moved from the extended position shown in FIG. 5 to the retracted position shown in FIG. 4 thereby shifting the sheave 64 rearwardly of the trough trestle T to thereby move the trough T' into its retracted position shown in FIG. 4. The piston rod 61 has a piston (not shown) that travels in either direction in the cylinder 60 to provide a means of positive control in both directions of travel to provide positive means to control the forces involved in accelerating and decelerating large masses, such as large diameter casing, drill collars and the like.

As shown in FIG. 2 of the drawings, the trough trestle T comprises a pair of flanged beam members 80 and 81 which are secured together at longitudinally spaced points by transverse web members 83. Secured in the inner facing sides of the beams 80 and 81 are a pair of inwardly facing U-shaped channel track members 85 and 86 which are provided for receiving rollers 87 and 88, respectively. Such rollers are secured by pins to parallel side members 90 and 91 which are connected by a transverse web member (not shown) to form the sides of the trough member T'. At the upper edges of the sides 90 and 91 are hinge members **90*a* and 91*a*, respectively having suitable openings therein for receiving pivot pins 95 (FIG. 3) for pivotally mounting a center section of the trough 96. It would be appreciated that there are a pair of longitudinally spaced hinge members 90*a* and 91*a* for receiving the pivot pins 95 in a number of places spaced along either edge of the trough 96. With this arrangement the trough member 96 may be tilted toward the side on which the pivot pins 95 are placed to enable the trough to discharge pipe to pipe racks on either side. Dual cylinder scissors jacks 101 and 102 are pivotally mounted on support arms 103 and 104 that are secured to the inner sides of the flanged beams 80 and 81, respectively. Such cylinders are pivoted on pivot pins 101*a* and 102*a*, respectively, which are carried by the support arms 103 and 104**.

The scissors arrangement comprises four arms 105, 106, 107 and 108, respectively which are pinned together at their respective ends by means of pins **105*a*, 106*a*, 107*a* and 108*a***, respectively.

Figure 3:
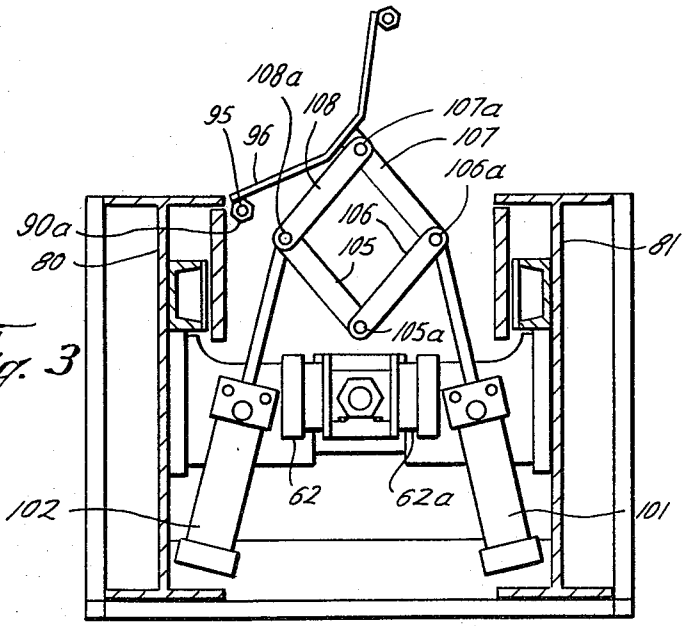
FIG. 3 is a section view similar to that shown in FIG. 2 but showing the trough in an elevated and tilted position for discharging pipe from the trough.

As shown in FIG. 2, the cylinders 101 and 102 are pivotally mounted on the transverse plates to permit free pivotal movement of the cylinder pistons **101*b* and 102*b*, respectively, upwardly against the pins 106*a* and 108*a*, respectively. Also shown in FIG. 1 the upper ends of the cylinder rods 101*b* and 102*b*, respectively are radiused for receiving pins 106*a* and 108*a*. As shown in FIG. 2, in the retracted position the radiused ends disengage the pins. With the trough 96 pinned to the hinge members 90*a*, when the piston rods 101*b* and 102*b* are extended upwardly and move the pins 108*a* and 106*a* upwardly, the trough 96 which is pivoted at 107*a* and 90*a* is tilted to the lefthand side as viewed in FIG. 3 of the drawings. It will be appreciated that by pinning the right hand edge of the trough 96, it will be tilted to the right as viewed in FIG. 3 when the scissors arrangement is in the elevated position as illustrated in FIG. 3. Thus, by pinning either one side or the other of the trough 96**, it may be tilted either right or left for receiving or discharging pipe from pipe racks placed on either side of the trough.

Figure 8A:
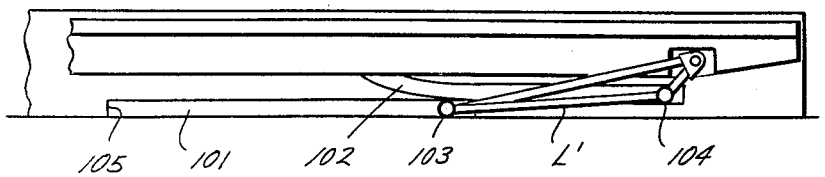
FIGS. 8A, B and C and 9A, B and C are schematic views illustrating the track for lifting the rear end of the trough trestle.
Figure 8B:
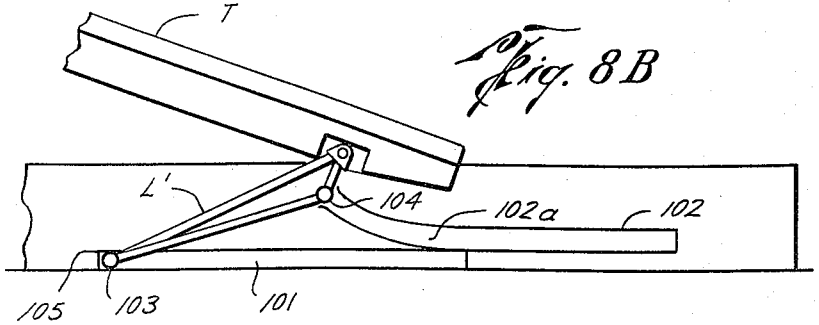
Figure 8C:
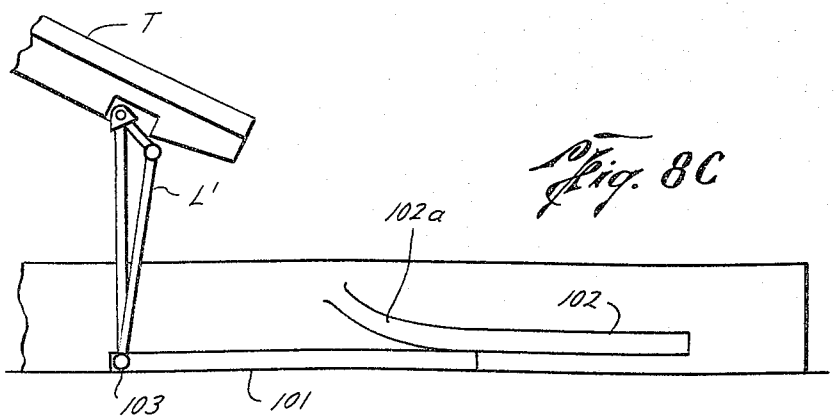

Shown in FIG. 8 of the drawings is an alternative embodiment of the track for guiding the articulated leg in raising the rear end of the trough trestle T. In the FIG. 8 embodiment there are two rear tracks; a substantially horizontal track 101 and upwardly curved track 102. The track 101 receives the lower end 103 of the articulated leg L' and the track 102 receives a roller 104 which is positioned at the rear end of the articulated leg. As shown in phantom in the drawing, movement of the front end of the trough trestle upwardly along the inclined track K causes the articulated leg to move forward along the tracks 101 and 102, the track 102 causing the leg to begin pivoting upwardly in the curved portion **102*a* and thereafter when the roller 103 strikes the stop 105 in the track 101**, the articulated leg L' is pivoted upwardly into a position for raising the rear end of the trough trestle T.

Figure 9A:
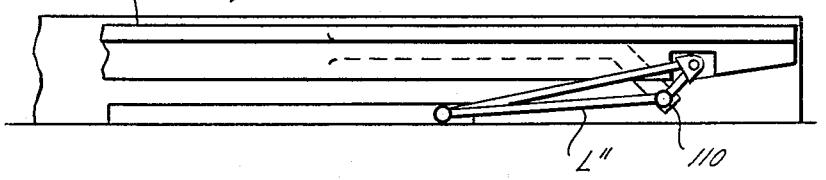
Figure 9B:
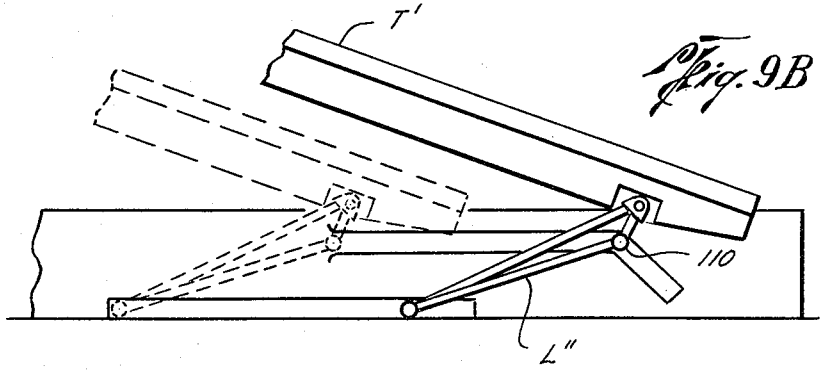
Figure 9C:
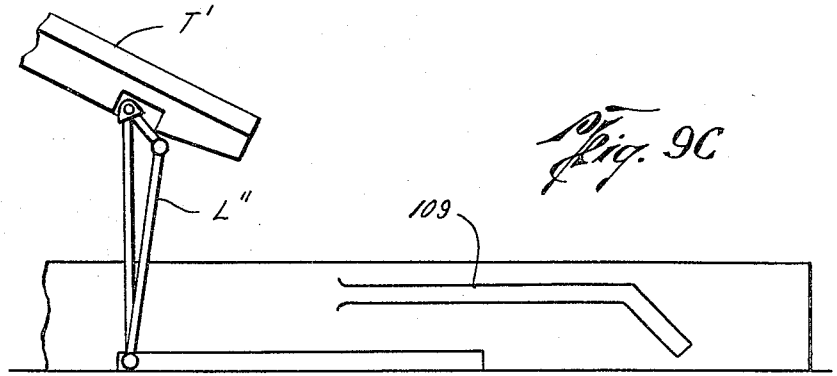

In FIG. 9 of the drawings is illustrated yet another embodiment of the means for guiding the movement of the articulated leg L'' and it is moved by movement of the forward end of the trough trestle T' upwardly along the inclined tracks K. In this embodiment the rear track 109 is inclined upwardly and then turned into a horizontal plane so that as the trough trestle T' begins its upward movement along the track K, the rear roller 110 will start up the inclined track and as it reaches the flat or substantially horizontal portion of the track 110, the rear of the trough trestle will move horizontally forward until such time that the lower end of the articulated leg reaches the stop in the lower track which will cause it to begin pivotal motion which will then cause the rear end of the trestle to again assume an upward and forward direction of movement.

Sliding the rear articulated leg forward as the carriage C is lifting the front end of the trough trestle T acts to increase the angle between the track trestle and the base prior to initiating an upward lifting moment on the rear end of the trough trestle, thus significantly reducing the force required to lift the rear end of the trough trestle T on the articulated leg L. This eliminates the need for an independent lifting apparatus which would otherwise be required with articulated lifting devices. It has been found that in the preferred embodiment, the trough trestle T should attain an angle of at least twenty-two degrees with respect to the longitudinal axis of the horizontal support base before the rear end of the trough trestle T' begins to swing vertically upwardly.

In operation of the apparatus of the present invention the trough trestle T begins in a retracted or nested position in the base support as illustrated in FIG. 1 of the drawings. The lift cylinder 32 is actuated causing the sheave 28 to move upwardly to the position shown in the FIG. 5 of the drawings thereby moving the carriage C upwardly to a position adjacent the rig floor F and moving the trough trestle T upwardly to the inclined position shown in FIG. 5 also. With the upward movement of the trough trestle T, the rear articulated leg L is caused to move forward in the track 48 until the forward end 46 of the leg L strikes the stop 48' and thereafter continued upward movement of the carriage along the inclined track K causes the articulated leg to be pivoted as shown in FIGS. 4 and 5 until it is in a substantially upright position and thereby lifts the rear end of the trough trestle to a sufficient height that the pipe P which projects out of the trough T' is positioned over the edge of the rig floor F at a height which the rig crew working on a rig floor can conveniently reach.

Once the trough trestle has been moved upwardly to the inclined position shown in FIG. 5, the dual acting piston in the cylinder 60 is actuated to move the sheave 62 upwardly to the position shown in FIG. 5 thereby shifting the trough T' to the extended position projecting out over the edge of the rig floor F. This movement positions the pipe P at a position to enable the crew on a rig floor to attach it to rig elevators (not shown) or other lifting apparatus to lift the pipe from the trough T' into a substantially vertical position in the rig where it can thereafter be lowered into position for connecting to a string of pipe supported in the rig.

In laying down pipe with the apparatus of the present invention it is first suspended in the rig and then swung over to place the lower end of the pipe in the extended trough T' and thereafter lowering of the lifting apparatus in the rig will lower the pipe as it is slid into the through until it strikes the hydraulic bumper 99 which is positioned at the rear end of the trough T'. With the pipe thus positioned in the trough T', the dual acting piston in the cylinder 60 is actuated to cause the sheave 64 to be moved downwardly into the position shown in FIG. 4 to thereby retract the trough in the trough trestle. Thereafter, downward movement of the carriage C is caused by lowering the piston in the cylinder 32 to turn the through trestle to the position shown in FIG. 1. With the trough in this position, the cylinders 101 and 102 are actuated to lift the scissors jack so as to lift the portion of the trough T' which is pivotally mounted as shown in FIG. 2 to a position such as shown in FIG. 3 to thereby tilt to one side and cause the pipe carried in the trough to be rolled out of the trough and onto an adjacent pipe rack.

The foregoing disclosure and description of the invention are illustrative and explanatory thereof and various changes in the size, shape and materials as well as in the details of the preferred embodiment may be made without departing from the spirit of the invention.

I claim:

1. A pipe pick-up and lay-down machine for transporting joints of pipe between positions adjacent a pipe storage rack and a rig floor elevated above the pipe storage rack comprising:

(a) a longitudinally extending base support means adapted to be set in a generally horizontal position for receiving lengths of pipe from adjacent pipe storage racks;

(b) track means secured to the forward end of said longitudinally extending base support means and inclined upwardly and outwardly from the end of said base support means to a position adjacent one side of an elevator floor of a drilling rig;

(c) longitudinally extending trough trestle means having pipe receiving means telescopically mounted therein with means for telescopically extending and retracting said pipe receiving means with respect to said trough trestle means;

(d) a carriage pivotally secured to one end of said trough trestle means with roller means on said carriage for engaging said track means;

(e) hydraulic lift means connected to said carriage for moving said carriage and the forward end of said trough trestle means secured thereto upwardly and downwardly along said inclined track means from a position nested in said base support means to a position adjacent said side of the elevator rig floor;

(f) longitudinally extending rear track means near the end of said base support means opposite two said inclined track means and having stop means at the end of said track means nearest said inclined track means;

(g) articulated leg means having one end pivotally connected to said trough trestle means and the other end received in said longitudinally extending rear track means whereby said articulated leg means is moved along said longitudinally extending track means as the front end of said trough trestle means is elevated along an inclined track means until said articulated leg means is stopped by said stop means and thereafter continued upward movement of said carriage along said inclined track means will cause said articulated leg means to pivot upwardly raising the rear end of said trough trestle.

2. A pipe pick-up and lay-down machine for transporting joints of pipe between positions adjacent a pipe storage rack and a rig floor elevated above the pipe storage rack comprising:

(a) a longitudinally extending base support means;

(b) inclined track means secured to the forward end of said base support means and extending upwardly to an elevated floor of a drilling rig;

(c) longitudinally extending trough trestle means having pipe receiving means telescopically mounted therein with means for telescopically extending and retracting said pipe receiving means with respect to said trough trestle means;

(d) means operably connecting a carriage to said inclined track means;

(e) means for moving said carriage and said trough trestle means secured thereto along said inclined track means;

(f) horizontal track means on said base support means with stop means at the forward end of said horizontal track means; and (g) means on said horizontal track means for raising the rear end of said trough trestle after said trough trestle has been inclined at least twenty-two degrees relative to the longitudinal axis of said base support means.

* * * * *